US011242652B2

(12) United States Patent
Heiskanen et al.

(10) Patent No.: US 11,242,652 B2
(45) Date of Patent: Feb. 8, 2022

(54) SHEET HAVING IMPROVED DEAD-FOLD PROPERTIES

(71) Applicant: Stora Enso OYJ, Helsinki (FI)

(72) Inventors: Isto Heiskanen, Imatra (FI); Esa Saukkonen, Lappeenranta (FI)

(73) Assignee: STORA ENSO OYJ, Helsinki (FI)

( * ) Notice: Subject to any disclaimer, the term of this patent is extended or adjusted under 35 U.S.C. 154(b) by 306 days.

(21) Appl. No.: 16/075,715

(22) PCT Filed: Feb. 17, 2017

(86) PCT No.: PCT/IB2017/050913
§ 371 (c)(1),
(2) Date: Aug. 6, 2018

(87) PCT Pub. No.: WO2017/141205
PCT Pub. Date: Aug. 24, 2017

(65) Prior Publication Data

US 2019/0040582 A1 Feb. 7, 2019

Related U.S. Application Data

(60) Provisional application No. 62/297,279, filed on Feb. 19, 2016.

(51) Int. Cl.

| | |
|---|---|
| ***D21H 15/00*** | (2006.01) |
| ***D21H 11/18*** | (2006.01) |
| ***D21H 11/16*** | (2006.01) |
| ***B65D 65/38*** | (2006.01) |
| ***B65D 85/10*** | (2006.01) |
| ***D21H 17/35*** | (2006.01) |
| ***D21H 17/67*** | (2006.01) |
| ***D21H 17/68*** | (2006.01) |
| ***D21H 19/10*** | (2006.01) |
| ***D21H 15/02*** | (2006.01) |
| ***D21F 11/02*** | (2006.01) |
| ***D21H 21/28*** | (2006.01) |
| ***D21H 27/10*** | (2006.01) |

(52) U.S. Cl.
CPC ..... *D21H 15/02* (2013.01); *B65D 65/38* (2013.01); *B65D 85/10* (2013.01); *D21F 11/02* (2013.01); *D21H 11/16* (2013.01); *D21H 11/18* (2013.01); *D21H 15/00* (2013.01); *D21H 17/35* (2013.01); *D21H 17/675* (2013.01); *D21H 17/68* (2013.01); *D21H 19/10* (2013.01); *D21H 21/28* (2013.01); *D21H 27/10* (2013.01)

(58) Field of Classification Search
CPC ..... D21H 15/00; D21H 15/02; D21H 17/675; D21H 17/68; D21H 11/16; D21H 11/18; D21H 17/35; D21H 19/10; D21H 21/28; D21H 27/10; D21H 17/63; D21H 17/67; B65D 65/38; B65D 85/10; D21F 11/02
See application file for complete search history.

(56) References Cited

U.S. PATENT DOCUMENTS

| | | | | |
|---|---|---|---|---|
| 4,786,533 | A | 11/1988 | Crass et al. | |
| 4,965,135 | A | 10/1990 | Im et al. | |
| 10,137,392 | B2 * | 11/2018 | Snyder | B01D 39/18 |
| 2007/0178262 | A1 * | 8/2007 | McGuire | B65D 65/14 428/35.2 |
| 2009/0047525 | A1 * | 2/2009 | Tilton | B32B 3/263 428/441 |
| 2010/0204379 | A1 * | 8/2010 | Pira | C08J 5/18 524/427 |
| 2011/0189435 | A1 | 8/2011 | Manifold et al. | |
| 2013/0068867 | A1 * | 3/2013 | Hermans | D21H 27/002 242/160.4 |
| 2013/0209772 | A1 | 8/2013 | Sandstrom et al. | |
| 2015/0315747 | A1 * | 11/2015 | Heiskanen | A47L 13/16 162/181.2 |
| 2016/0069027 | A1 * | 3/2016 | Hermans | D21H 27/002 162/111 |
| 2016/0194831 | A1 * | 7/2016 | Olkkonen | D21H 21/36 162/137 |
| 2017/0009108 | A1 * | 1/2017 | Mitchell | C09J 7/29 |
| 2017/0145636 | A1 * | 5/2017 | Zhou | D21H 17/675 |
| 2019/0040582 | A1 * | 2/2019 | Heiskanen | D21H 15/00 |
| 2019/0047273 | A1 * | 2/2019 | Heiskanen | B32B 29/08 |
| 2019/0127920 | A1 * | 5/2019 | Svending | D21H 17/28 |
| 2020/0332472 | A1 * | 10/2020 | Ziegenbein | D21H 11/08 |
| 2020/0340182 | A1 * | 10/2020 | Shanmuganathan | D21H 11/14 |

FOREIGN PATENT DOCUMENTS

| | | | |
|---|---|---|---|
| CN | 1398766 | A | 2/2003 |
| EP | 0148567 | | 7/1985 |
| JP | 2012149355 | A | 8/2012 |

(Continued)

OTHER PUBLICATIONS

Machine Translation of JP-2012158137 A. (Year: 2012).*
G> A. Smook "Handbook for Pulp & Paper Technologists" 2nd edition, chapter 2, p. 15. (Year: 1992).*
International Searching Authority, Written Opinion of the International Searching Authority, PCT/IB2017/050913, dated Aug. 24, 2017.
International Searching Authority, International Search Report, PCT/IB2017/050913, dated Apr. 18, 2017.

(Continued)

*Primary Examiner* — Jose A Fortuna

(74) *Attorney, Agent, or Firm* — Greer, Burns & Crain, Ltd.

(57) ABSTRACT

A sheet having dead-fold properties, wherein said sheet comprises cellulose fibers whereof at least 75%, preferably at least 90%, or more preferably at least 95% of said cellulose fibers have a fiber length of less than 1 mm, and wherein the tensile strength ratio (MD/CD) of the film is above 1.4, preferably higher than 1.6 and most preferably higher than 1.8.

30 Claims, No Drawings

(56) References Cited

FOREIGN PATENT DOCUMENTS

| | | | | |
|---|---|---|---|---|
| JP | 2012158137 | A | 8/2012 | |
| JP | 2013533899 | A | 8/2013 | |
| JP | 2015196918 | A | 11/2015 | |
| RU | 2130100 | C1 | 5/1999 | |
| WO | 2012017953 | A1 | 9/2012 | |
| WO | 2013160553 | | 10/2013 | |
| WO | 2014071523 | | 5/2014 | |
| WO | 2014091413 | | 6/2014 | |
| WO | WO-2014091413 | A1 * | 6/2014 | ..... D21H 17/675 |
| WO | 2014147295 | | 9/2014 | |
| WO | 2015032432 | | 3/2015 | |
| WO | WO-2017141205 | A1 * | 8/2017 | ..... D21H 15/00 |

OTHER PUBLICATIONS

Erkkila A.-L., Pakarinen, P., Odell, M. "Sheet forming studies using layered orientation analysis." Pulp & Paper Sanada, vol. 99, Iss. 1, (Jan. 1998) 81.

First Office Action translation from corresponding Chinese patent application No. 201780008513.9 dated Oct. 27, 2020.

Translation of Japanese Office Action for corresponding Japanese patent application No. 2018-543171 dated Jan. 18, 2021.

* cited by examiner

SHEET HAVING IMPROVED DEAD-FOLD PROPERTIES

This application is a U.S. National Stage under 35 U.S.C. §371 of International Application No. PCT/IB2017/050913, filed Feb. 17, 2017, which claims priority to U.S. Provisional Patent application no. 62/297,279, filed Feb. 19, 2016.

TECHNICAL FIELD

The present invention relates to a thin sheet having improved dead-fold properties. The sheet may be translucent or transparent.

BACKGROUND

At the moment, there are several applications (mostly packaging related) where packaging films needs to be converted. In many cases, these folded packaging needs to be stable and not allowed to bounce back to its original shape. This type of fold and behavior is called dead-fold. Such dead-fold behavior is required in many applications including innerliner in cigarette packages, candy twist wraps, flexible walled containers, food wraps etc.

Further, polymer films typically do not have good dead-fold properties and several attempts as described in for instance U.S. Pat. No. 4,786,533; EP0148567; U.S. Pat. No. 4,965,135 have been made to improve the dead-fold properties of these films.

For instance, for candy wraps this "dead fold" is produced by optimizing the fiber orientation in the machine direction. However, such a solution has not given a satisfying result and oftentimes dead-fold has only been achieved in one direction.

There are also other techniques to achieve or control dead-fold. For instance, for many inner liners dead fold is achieved through a metallization process, where coated paper is metallized in vacuum conditions. This is a solution that gives relatively good dead fold behavior in both directions. The technique does have some drawbacks in that in certain cases some of the metallization is not adhered perfectly to the coated paper, meaning that some metal might migrate. Due to customers' increasing awareness of the potential negative effects of using aluminum in food packages, environmental reasons such as $CO_2$ footprint or recyclability, this solution is currently not growing. Further in many cases metallized paper has been replaced with plastic solutions. Another problem with metallization is cost because it is a slow process and requires often special paper grades. In the published patent application WO2015032432A1, a thin (25.5-34 g/m$^2$) food wrap paper is disclosed with improved dead-fold stiffness, but the solution is based on a surface treatment.

Consequently, there is a need to find more sustainable solutions compared to the conventional techniques. There is thus a need to find a translucent/transparent thin film or paper with high dead-fold properties, which can be manufactured in a paper machine.

SUMMARY

It is an object of the present disclosure, to provide an improved dead-folded sheet, such as for instance a thin sheet of paper/film, which may be translucent or transparent.

The invention is defined by the appended independent claims. Embodiments are set forth in the appended dependent claims and in the following description.

According to a first aspect there is provided a sheet having dead-fold properties, wherein said sheet comprises cellulose fibers whereof at least 75%, preferably at least 90%, or more preferably at least 95% of said cellulose fibers have a fiber length of less than 1 mm, and wherein the tensile strength ratio (MD/CD) of the film is above 1.4, preferably higher than 1.6 and most preferably higher than 1.8.

The tensile strength ratio defines the fiber orientation of the sheet, and in this way, a sheet with high dead-fold stiffness in both directions of the sheet is provided. The sheet can be made with high dead-fold stiffness or dead-fold behavior without any surface treatment process such as surface sizing, impregnation or metallization or lamination. Through this sheet it is also possible to improve dead-fold properties of plastic films, when used as multilayer structure with the sheet.

The sheet may be any one of thin paper substrates, films, nano-papers or similar substrates.

The remaining 0-25% of the cellulose fibers may comprise cellulose fibers having a length of >1 mm, and wherein said longer cellulose fibers have a length of at least 2 mm, or at least 2.5 mm, or at least 3 mm.

The cellulose fibers having a length of <1 mm may be obtained through any one of a cutting and fibrillation technique or a combination thereof.

The moisture content of the sheet may be below 8 weight-%, preferably below 6 weight-%, and most preferably below 4 weight-%.

The lower the end moisture, i.e. the moisture in the end product, the better dead-fold properties may be obtained.

The cellulose fibers having a fiber length of less than 1 mm may be nanofibrillated polysaccharide, wherein said nanofibrillated polysaccharide is is any one of microfibrillated cellulose and nanocrystalline cellulose.

The sheet may further comprise fillers, in an amount of more than 3 weight-% of the weight of the sheet, preferably of more than 7 weight-% and said filler may be any one of precipitated calcium carbonate(PCC), ground calcium carbonate (GCC), kaolin, bentonite and talc or a combination or mixture thereof.

The sheet may further comprise a colorant.

The sheet may have a basis weight of less than 50 g/m$^2$, or preferably less than 25 g/m$^2$.

Said cellulose fibers having a length of <1 mm may be highly refined cellulose fibers having a Schopper-Riegler (SR) value of above 70, more preferably above 90 or even above 92.

The sheet may be transparent or translucent.

According to a second aspect there is provided a method of manufacturing a sheet having dead-fold properties according to the first aspect, wherein said sheet comprises cellulose fibers whereof at least 75%, or preferably at least 90%, or even more preferred at least 95% of said cellulose fibers have a fiber length of less than 1 mm, and wherein the tensile strength ratio (MD/CD) of the film is above 1.4, preferably higher than 1.6 and most preferably higher than 1.8, wherein said cellulose fibers having a fiber length of less than 1 mm have a Schopper-Riegler (SR) value of more than 70 in a paper making machine, wherein said method comprises the steps of; providing a suspension comprising a mixture of cellulose fibers having a length of less than 1 mm and cellulose fibers having a length of more than 2 mm, forming a web or film of said solution, drying or dewatering said formed film or web, thereby forming said sheet having dead-fold properties.

The step of forming a web may be any one of providing said suspension to a wire of said paper making machine, and providing said suspension to a substrate in a cast coating operation.

The sheet may have a moisture content of less than 10%, preferably less than 8%, or even more preferred of less than 4% after the drying or dewatering step.

The sheet may have a basis weight of less than 50 g/m$^2$, or preferably less than 25 g/m$^2$.

The method may further comprise the step of: calendering said formed film or web, and wherein the step of calendaring is performed prior to, after or simultaneously with the drying step.

According to the second aspect the method may comprise obtaining a desired fiber orientation of said sheet through any one of adjusting a jet to wire ratio, adjusting laminar shear on the wire, adjusting the wet web and/or dry web tension, creating turbulence by pulsation when forming said web or film, and adjusting fiber composition of the suspension comprising cellulose fibers, or a combination thereof.

According to a third aspect there is provided a sheet having dead-fold properties obtained by the method according to the second aspect.

According to a fourth aspect there is provided a laminate comprising the sheet according to the first aspect or the third aspect and at least one second layer, wherein said second layer may comprise any one of a polymer, wax and mineral.

The polymer may for instance be polyethylene (PE). According to one alternative the sheet may be cast coated directly onto a polymer layer (e.g. PE) forming said laminate. Alternatively, the additional layer may be coated or laminated onto the first sheet.

According to a fifth aspect there is provided the use of a sheet according to the first or third aspect as inner liner of cigarette packaging, as candy wrap paper or as food wrap paper.

According to a sixth aspect there is provided an inner liner for a cigarette packaging which inner liner comprises the sheet according to the first or third aspect.

According to a seventh aspect there is provided an inner liner for a cigarette packaging, which inner liner is composed of the sheet according to the first and third aspect.

According to an eight aspect there is provided a candy- or food wrap comprising or consisting of the sheet according to the first and third aspect or a laminate according to the forth aspect.

According to a ninth aspect there is provided the use of a sheet according to the first or third aspect, or a laminate according to the fourth aspect as a blank for dead-folding applications. Such dead-fold application may include not only packaging and food applications, but also application in electronics, for screens etc.

DESCRIPTION OF EMBODIMENTS

According to the invention a sheet having dead-fold properties is formed from a suspension comprising cellulose fibers. The sheet is mainly based on highly refined fibers having an Schopper Riegler (SR) value of >70 or more preferably >90, and most preferably >92, wherein these fibers have a length of less than 1 mm. The sheet comprises at least 75 weight-% based on the total amount of fibers in the sheet of these cellulose fibers having a length of less than 1 mm. Preferably the amount of these fibers having a length of less than 1 mm is more than 80 weight-%, or more than 90 weight-%, or even more preferred more than 95 weight-%.

These cellulose fibers having a length of less than 1 mm, may be a nanofibrillated polysaccharide or nanocellulose, wherein said nanofibrillated polysaccharide or nanocellulose is any one of microfibrillated cellulose and nanocrystalline cellulose.

It has surprisingly been found that paper/film based on these highly refined and short fibers (SR>70 or more preferably >90, most preferably >92), has a tensile strength ratio (MD/CD) of more than 1.4, preferably more than 1.6 and most preferably more than 1.8 has improved dead-fold properties. The sheet may be transclucent/or transparent. This means that the sheet can be made with high dead-fold stiffness or dead-fold behavior without any surface treatment process such as surface sizing, impregnation or metallization or lamination.

The term "sheet" is meant to include thin paper substrates, films, nano-papers or similar substrates. By the term "sheet" is thus meant a web formed or cast coated article, such as e.g. film.

The sheet may be made in a paper making machine, such as a Fourdrinier machine. The sheet may thus be made by use of wet-laid technologies, such as by using a wire or permeable carrier substrate. Alternatively, the sheet may be made by cast coating techniques, e.g. by coating a carrier substrate and thereafter removing the formed sheet/film from the carrier substrate. The thin paper or film produced according to the invention shows further features such as grease proof properties (without wax or plastic coating), gas or aroma barriers, mineral oil barriers, printable, anti-counterfeit (e.g. markers or laser marking), semi-transparent or optical effects, optical barrier e.g. UV barrier, etc.

The oxygen transmission rate (OTR) value of the sheet may preferably be less than 1000 cc/m$^2$*day at 23° C. and 50% relative humidity (RH), and more preferred less than 750 cc/m$^2$*day at 23° C. and 50% RH, and even more preferred less than 100 cc/m$^2$*day at 23° C. and 50% RH. One characteristic of the sheet is that is comprises low amounts of long fibers. Lower amount of coarse fibers improves dead-fold, and the amount of long or coarse fibers should preferably be less than 25%, more preferably less than 15%, most preferably less than 10%. The amount of long fibers is e.g. identified by fractionation using a DDJ apparatus or e.g. by sedimentation methods. A coarse indication can also be obtained by simply calculating fibers by using a microscope, or optical fiber analyzer.

By long fiber is meant e.g. Kraft fiber of hardwood or softwood, (synthetic fiber), bagasse, dissolving pulp, or including all pulps typically longer than 1 mm and having a fiber diameter >20 μm.

The long fibers may further have a length of at least 2 mm, or at least 2.5 mm or even at least 3 mm.

The long fibers may be from softwood source, e.g. pine or spruce. The long fibers may also contribute to an improved tear strength of the sheet, compared to shorter fibers. Alternatively, the long fibers may be made of hardwood, such as birch.

The orientation of the fibers in the sheet, and/or the (micro)fiber, is characterized by the sheet having a tensile strength ratio (MD/CD) of more than 1.4, preferably more than 1.6 and most preferably more than 1.8. The tensile strength ratio is measured by conventional standard methods as described in EN ISO 5270, EN ISO 1924, SCAN-P 67.

The sheet preferably has a low grammage or basis weight. The basis weight is preferably below 50 g/m$^2$, and most preferably below 25 g/m$^2$.

According to one alternative the sheet may be calendered, which improves dead-fold even further.

According to one alternative the sheet may comprise a colorant. The colorant may be a dye or a pigment based colorant. Said colorant may optionally be added in the wet end of the paper making process, or alternatively included during manufacturing of microfibrillated cellulose (MFC) manufacturing. The colorant can also be a fluorescent or other types of "non-visible" colorants.

The total amount of cellulose fibers in the sheet may be at least 80 weight % based on the total weight of the sheet. The remaining 0-20% may comprise any conventional paper-making additives and chemicals.

A typical furnish composition used to make the sheet may include 95% MFC (SR>90), 5% kraft fiber, +process additives such as retention aids.

Alternatively, the furnish comprises 100% MFC+process additives, fillers or other performance chemicals.

Preferably the end product sheet has a moisture content of below 8% and most preferably below 4%.

Higher filler content improves the dead-fold. Preferably higher than 3% and most preferably higher than 7%

The sheet may be made from highly refined fibers or MFC having a Schopper-Riegler (SR) value of above 70, more preferably above 90 or even above 92. Said SR value defines the SR value measured for the pulp without added chemicals. The final furnish, comprising further additives, may show a different SR value. The fibrillation of fibers can be measured by determining Schopper Riegler (SR) value or Canadian standard freeness (CSF). Standard methods for measuring SR value is ISO 5267-1:1999, SS-EN ISO 5267-1:2000 and CSF values ISO 5267-2:2001.

The sheet is preferably a two-sidedness sheet, meaning that the top and back side properties differs e.g. with regard to concentration of short fibers or surface roughness. This has shown to have beneficial effects on the dead-fold properties. This is a feature of at least papers formed on a Fourdrinier type machines where the two-sidedness is achieved automatically.

The preferred fiber orientation (i.e. the preferred tensile strength ratio) may be obtained by for instance adjusting jet to wire ratio. The adjustment of the jet-to-wire speed ratio permits to change the strength properties of the paper.

The jet (speed of head box flow) to wire (speed of wire) ratio, will depend on several different factors, such as the machine type, head box type, fibers used, the consistency of the fiber solution, the wire shaking and the average speed of the wire. In cast coating the speed of belt or web onto which casting is done will be one determining factor.

Another way of obtaining the preferred fiber orientation is by providing a laminar shear on the wire. This may be performed by e.g. wire shaking on Fourdrinier type paper machine.

Yet another way of obtaining the preferred fiber orientation may be by adjusting and controlling the wet web tension and/or the dry web tension.

The preferred fiber orientation may also be obtained by adjusting the fiber composition. Adjusting the fiber composition of the furnish will affect the hydrodynamic properties and friction.

The fiber composition may be analyzed e.g. with on-line fiber analyzers, which are based on optics.

The desired fiber orientation may also be obtained by adjusting the flow behavior e. g. creating turbulence by pulsation, may cause less orientation effects etc. This may be performed when forming the paper web from the head-box to the wire.

It is also possible to combine different techniques to obtain the desired fiber orientation, and thus the desired tensile strength ratio (MD/CD) of the sheet.

The fiber orientation in the sheet may be measured and characterized by different techniques.

One way is by measuring the orientation of edges of fiber segments (Erkkilä, A-L., Pakarinen, P., Odell, M., Pulp Pap. Can. 99(1): 81 (1998). Other techniques include image analyses of e.g. dyed or tracer fibers. The MD/CD ratio R of tensile strength and the MD/CD ratio R of elastic modulus may also be measured.

The dielectric permittivity, ultrasound or microwave transmittance to determine elastic modulus and then further the fiber orientation in the sheet. It is also possible to use optical measurements, such as light diffraction to determine the fiber orientation.

Without bound to any theory, be believe that this "dead fold" phenomenon is related to the properties of individual fibers. As fibers form thigh structure with orientated micro fibrils, they are able to resist bending force very well and bounce back after bending. If this this fiber structure is destroyed into individual microfibers, and then a film/paper is formed from this material, then the formed film has lost is "spring back" after folding.

Wax pouch structures additionally have stiffness and dead-fold characteristics that enable the formed, empty pouch to stay open and hold its shape as the pouch is transported to filler units over long distances.

Dead-fold refers to a measure of the ability of the packaging material to retain a fold or crease. A simple test for dead-fold property may involve stamping a 180° fold in the packaging material at ambient temperature and then measuring the angle to which the fold opens thereafter. The lower or smaller recovery angles are desirable because this indicates greater dead fold retention.

In the context of this application and the attached patent claims, by the term "fiber length" is meant the arithmetic average length of fiber; which can be measured e.g. according to TAPPI standard (Kajaani FS5 Optical fiberanalyser, Metso Automation).

According to one alternative the sheet may form a laminate with at least one second layer. According to one alternative the sheet may be provided with the second layer being any one of a polymer layer, such a polyethylene (PE) coating layer or a wax layer. The polymer or wax layer may be provided onto the film or substrate by any conventional means such as roll coating, spray coating, lamination and extrusion. This may be done in a separate converting step, on-line or off-line. The sheet may also be cast coated directly onto a plastic substrate, where the substrate then forms the second layer.

The thickness of the wax or polymer layer may be in the range of 5 to 30 μm, preferably around 20 μm.

By providing the above mentioned sheet with, for instance, a PE coating layer it is possible to achieve an OTR value of the laminated sheet of less than 100 cc/m$^2$*day determined at 23° C. and 50% RH.

Trials

A Kraft pulp fiber was refined until Schopper Riegler value was >96 (94-100). A wet laid technique or papermaking method similar to Fourdrinier was used to form a web thereof having a grammage of ca 30 g/m$^2$. Different amount of hardwood pulp (birch, low SR value, below 25) was used as a long fiber fraction in the furnish. In addition to the fiber furnish, process chemical such as cationic starch (4 kg/tn), hydrophibic sizing chemicals were used (1.5 kg/tn).

The wet web was run through a press section and then dried until a moisture content of ca 6 weight-%.

A polyethylene coating layer was extruded onto the films or substrates in a separate converting step. The thickness of PE layer is about 20 μm.

Dead-fold measurements were made on samples (non PE coated) (W=55 mm, L=155 mm) by folding at distance 55 mm from edge for the side to be investigated.

Below the sample, a suction board was placed to supports the substrate during folding. The sample was folded 180 degrees on to top-side or bottom-side and then a 0.957 kg weight or 5.5 kg weight was added onto the folded sample for 5 seconds.

The angle was then measured after 1 hour. The MFC film materials described herein do not significantly straighten (e.g., to not more than about 150 degrees in maximum with 0.957 kg weight, and not more than about 170 degrees in maximum with 5.5 kg weight) after being folded.

TABLE 1

Results of dead-fold trials

| Recipe | Ref | 1 | 2 | 3 | Commercial cigarette inner liner | Copy paper, 80 gsm |
|---|---|---|---|---|---|---|
| Nanocellulose, SR 96 | 100% | 85% | 70% | 50% | | |
| Kraft Pulp, birch | | 15% | 30% | 50% | | |
| Starch | 4 kg/tn | 4 kg/tn | 4 kg/tn | 4 kg/tn | | |
| Hydrophobic sizing chemical | 1.5 kg/tn | 1.5 kg/tn | 1.5 kg/tn | 1.5 kg/tn | | |
| Physical properties | | | | | | |
| Grammage, g/m$^2$ | 29.7 | 31.1 | 30.8 | 30.2 | | |
| Moisture content, wt % | 6.80 | 6.22 | 6.86 | 6.81 | | |
| Opacity C/2° + UV, Top side, % | 26.6 | 27.7 | 30.8 | 37.7 | | |
| Opacity C/2° + UV, Bottom side, % | 26.9 | 27.8 | 31.1 | 38.4 | | |
| Film properties | | | | | | |
| OTR 23° C./50% RH | 30.4 | 6604 | no O2 barrier | no O2 barrier | | |
| OTR after PE Coating, 23° C./50% RH | 1.65 | 3 | 90.85 | 525 | | |
| Dead-fold, angle MD (Top-side/back-side), 0.957 kg weight, recovery angle | 21/17 | 20/12 | 17/12 | 24/23 | | |
| Dead-fold, angle CD (Top-side/back-side), 0.957 kg weight, recovery angle | 12/18 | 10/4 | 8/16 | 10/20 | | |
| Dead-fold, angle MD (Top-side/back-side), 5.5 kg weight, recovery angle | 4/0 | 5/6 | 3/3 | 5/7 | –/33 | 43/47 |
| Dead-fold, angle CD (Top-side/back-side), 5.5 kg weight, recovery angle | 2/2 | 2/6 | 2/2 | 6/12 | | 22/16 |

In another trial, an MFC film of around 40 gsm was produced by cast coating from a suspension comprising MFC and 30% sorbitol. This film showed a recovery angle of 0 degrees.

The invention claimed is:

1. A sheet having dead-fold properties comprising:

cellulose fibers wherein at least 75% of said cellulose fibers have a fiber length of less than 1 mm, wherein the remaining cellulose fibers in the sheet comprise cellulose fibers having a length of >2 mm;

wherein the moisture content of the sheet is below 10 weight-%, wherein the tensile strength ratio (MD/CD) of the sheet is above 1.4, wherein the sheet is coated with a layer comprising a polymer or a wax, wherein the layer has a thickness between 5 to 30 micrometers, and wherein a basis weight of the sheet is less than 50 g/m$^2$.

2. The sheet according to claim 1, wherein the sheet is a paper substrate selected from films or nano-papers.

3. The sheet according to claim 1, comprising cellulose fibers having a length of >2.5 mm.

4. The sheet according to claim 1, wherein the cellulose fibers having a length of <1 mm are obtained through any one of a cutting and fibrillation technique or a combination thereof.

5. The sheet according to claim 1, wherein the moisture content of the sheet is below 8 weight-%.

6. The sheet according to claim 1, wherein the cellulose fibers having a fiber length of less than 1 mm is a nanofibrillated polysaccharide, wherein said nanofibrillated polysaccharide is any one of microfibrillated cellulose and nanocrystalline cellulose.

7. The sheet according to claim 6, wherein said filler is any one of precipitated calcium carbonate (PCC), ground calcium carbonate (GCC), kaolin, bentonite and talc or a combination or mixture thereof.

8. The sheet according to claim 1, wherein the sheet further comprises fillers, in an amount of more than 3 wt-% of the total weight of the sheet.

9. The sheet according to claim 1, wherein the sheet further comprises a colorant.

10. The sheet according to claim 1, wherein the sheet has a basis weight of less than 25 $g/m^2$.

11. The sheet according to claim 1, wherein said cellulose fibers having a length of <1 mm are highly refined cellulose fibers having a Schopper-Riegler (SR) value of above 70.

12. The sheet according to claim 1, wherein the sheet is transparent or translucent.

13. An inner liner for a cigarette packaging which inner liner comprises the sheet according to claim 1.

14. An inner liner for a cigarette packaging, wherein the inner liner consists of the sheet according to claim 1.

15. A candy- or food wrap comprising the sheet according to claim 1.

16. The sheet according to claim 1, wherein said sheet comprises cellulose fibers whereof at least 90% of said cellulose fibers have a fiber length of less than 1 mm.

17. The sheet according to claim 1, wherein said sheet comprises cellulose fibers whereof at least 95% of said cellulose fibers have a fiber length of less than 1 mm.

18. The sheet according to claim 1, wherein the tensile strength ratio (MD/CD) of the sheet is higher than 1.6.

19. The sheet according to claim 1, wherein the tensile strength ratio (MD/CD) of the sheet is higher than 1.8.

20. A method of manufacturing a sheet having dead-fold properties in a paper making machine, wherein said sheet comprises cellulose fibers whereof at least 75% of said cellulose fibers have a fiber length of less than 1 mm, and wherein the tensile strength ratio (MD/CD) of the sheet is above 1.4, wherein said cellulose fibers having a fiber length of less than 1 mm have a Schopper-Riegler (SR) value of more than 70, wherein the sheet is coated with a layer comprising a polymer or a wax, and wherein the layer has a thickness between 5 to 30 micrometers, the method comprising the steps of:

providing a suspension comprising a mixture of cellulose fibers having a length of less than 1 mm and cellulose fibers having a length of more than 2 mm, forming a web or film of said suspension;

drying or dewatering said formed film or web, thereby forming said sheet having dead-fold properties, wherein said sheet has a moisture content of less than 10% after the drying or dewatering step, and wherein a basis weight of the sheet is less than 50 $g/m^2$; and coating said sheet with the layer comprising the polymer or the wax.

21. The method according to claim 20, wherein the step of forming a web is any one of providing said suspension to a wire of said paper making machine, and providing said suspension to a substrate in a cast coating operation.

22. The method according to claim 20, wherein said sheet has a moisture content of less than 8% after the drying or dewatering step.

23. The method according to claim 20, wherein the sheet has a basis weight of less than 25 $g/m^2$.

24. The method according to claim 20, wherein said method further comprises the step of:

calendering said formed film or web, and wherein the step of calendaring is performed prior to, after or simultaneously with the drying step.

25. The method according to claim 20, wherein the method comprises obtaining a desired fiber orientation of said sheet through any one of adjusting a jet to wire ratio, adjusting laminar shear on the wire, adjusting the wet web and/or dry web tension, creating turbulence by pulsation when forming said web or film, and adjusting fiber composition of the suspension comprising cellulose fibers, or a combination thereof.

26. A sheet having dead-fold properties obtained by the method according to claim 20.

27. The method according to claim 20, wherein said sheet comprises cellulose fibers whereof at least 90% of said cellulose fibers have a fiber length of less than 1 mm and wherein the remaining cellulose fibers in the sheet comprise cellulose fibers having a length of >2.5 mm.

28. The method according to claim 20, wherein said sheet comprises cellulose fibers whereof at least 95% of said cellulose fibers have a fiber length of less than 1 mm.

29. The method according to claim 20, wherein the tensile strength ratio (MD/CD) of the sheet is higher than 1.6.

30. The method according to claim 20, wherein the tensile strength ratio (MD/CD) of the sheet is higher than 1.8.

* * * * *